United States Patent [19]

Potter

[11] 4,120,222

[45] Oct. 17, 1978

[54] STAPLE LENGTH CUTTER WITH LOW NOISE LEVEL JET TO ASSIST IN DOFFING CUT STAPLE

[75] Inventor: Jerry Fuller Potter, Seaford, Del.

[73] Assignee: E. I. Du Pont de Nemours and Company, Wilmington, Del.

[21] Appl. No.: 833,895

[22] Filed: Sep. 16, 1977

[51] Int. Cl.[2] ..... D01G 1/04

[52] U.S. Cl. ..... 83/99; 83/169; 83/346; 83/913

[58] Field of Search ..... 83/98, 99, 22, 169, 83/346, 347, 913

[56] References Cited

U.S. PATENT DOCUMENTS

| | | | |
|---|---|---|---|
| 3,485,120 | 12/1969 | Keith | 83/913 X |
| 3,733,945 | 5/1973 | Cook | 83/99 X |

*Primary Examiner*—J. M. Meister

[57] ABSTRACT

A modification to a reel type staple cutter wherein a hollow drive shaft for the reel communicates with internal passageways in the top plate of the cutter reel. Holes are formed through the top plate at locations between adjacent cutter blade assemblies. Air fed through the shaft is continuously jetted through the holes against advancing wads of cut staple to strip off staple.

8 Claims, 7 Drawing Figures

STAPLE LENGTH CUTTER WITH LOW NOISE LEVEL JET TO ASSIST IN DOFFING CUT STAPLE

BACKGROUND OF THE INVENTION

The invention relates to apparatus for cutting elongated material into shorter lengths and the use of gas jets for uniformly removing the cut material. More particularly, the invention provides a means for avoiding any substantial increase in noise level ordinarily associated with the use of gas jets in this environment.

Cutters as described by Keith in U.S. Pat. No. 3,485,120 are broadly used for cutting tow into staple length fibers. These cutters include a rotatable reel having outwardly facing cutter blades against which the tow is wound and a fixed pressure roller pressing upon the tow wound around the reel resulting in cutting of the innermost layers of tow by the cutter blades. As cutting progresses a wad of cut staple fibers is forced inwardly between adjacent pairs of blades. Unfortunately, centrifugal forces and interfiber adhesion resist removal of wads of cut fibers by gravitational forces. Thus the wads of cut fibers continue to rotate with the reel and continue to increase in size until either the cutter jams or until chips of cohered staple break off from the wads and fall into the collection hopper. These chips provide low fiber openness and cause subsequent difficulties in mill processing.

Cook in U.S. Pat. No. 3,733,945 recognizes the problems of jamming the cutter and lack of staple openness using cutters described by Keith and as a solution to these problems Cook discloses mounting at least one fixed jet so that it jets air downwardly upon the proximity of the doffing point of the cut fiber through aligned apertures in the cutter reel which rotate past the jet. This assists the gravitational forces in overcoming the effect of centrifugal and fiber-to-fiber forces allowing the cut fiber to fall freely downward. However, Cook's arrangement has disadvantages associated with discontinuous passage of air from the fixed jet through apertures in the reel crossing through the air jet stream. Cook's arrangement is essentially that of a siren and as a consequence produces very high noise levels.

SUMMARY OF THE INVENTION

The present invention is a modification of the known reel type cutter wherein the jet-producing orifices rotate with the reel and by not interrupting jet-air flow, as with the prior art, a negligible increase in noise level results, regardless of orifice size or operating speed of the reel. The continuously operating jets of this invention provide a staple exhibiting uniform openness with substantially no fiber chips. More particularly, the invention involves an apparatus for cutting material into predetermined lengths comprising a cutting assembly including a plurality of knife edges secured to a reel having an upper and a lower mounting member and having means for receiving successive wrappings of material to be cut by contact with the knife edges. Means are provided for forcing the material between adjacent knife edges to a doffing point thereby severing the material into lengths of controlled dimensions. The improvement comprises means for removing the severed material that includes a plurality of orifices in the upper mounting member with at least one orifice between each pair of knife edges directed in the proximity of the doffing point of the severed material and means for continuously supplying pressurized fluid to each orifice.

DETAILED DESCRIPTION OF THE PREFERRED EMBODIMENT

Figure 1:
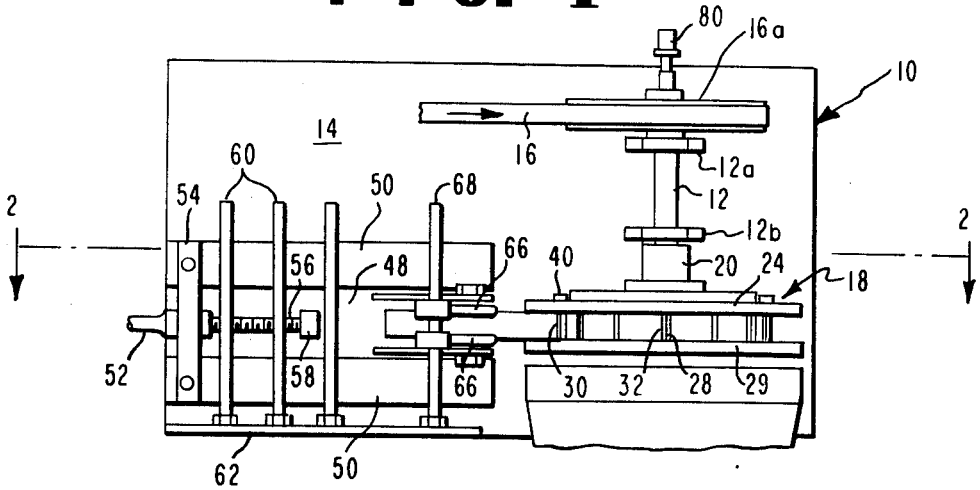
FIG. 1 is a side elevation of the cutting apparatus similar to the Keith apparatus illustrating the relationship between the various elements thereof and showing a preferred cutting reel configuration.
Figure 2:
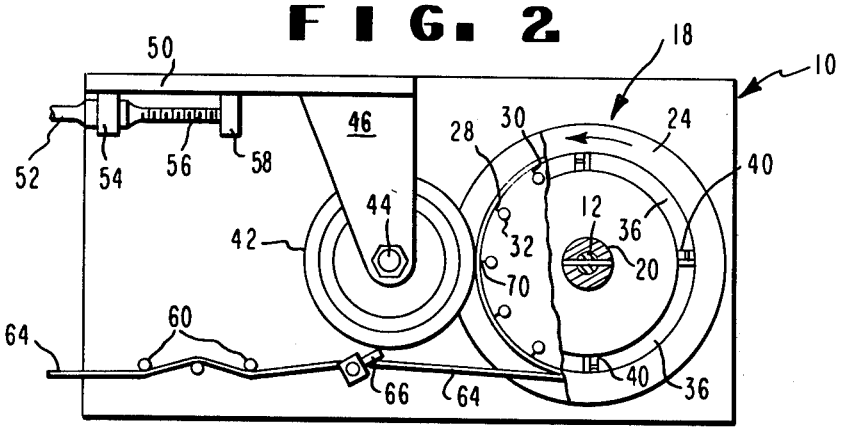
FIG. 2 is a view taken along 2—2 of FIG. 1 showing the relationship between the cutting reel, the pressure applicator and the material being severed.
Figure 3:
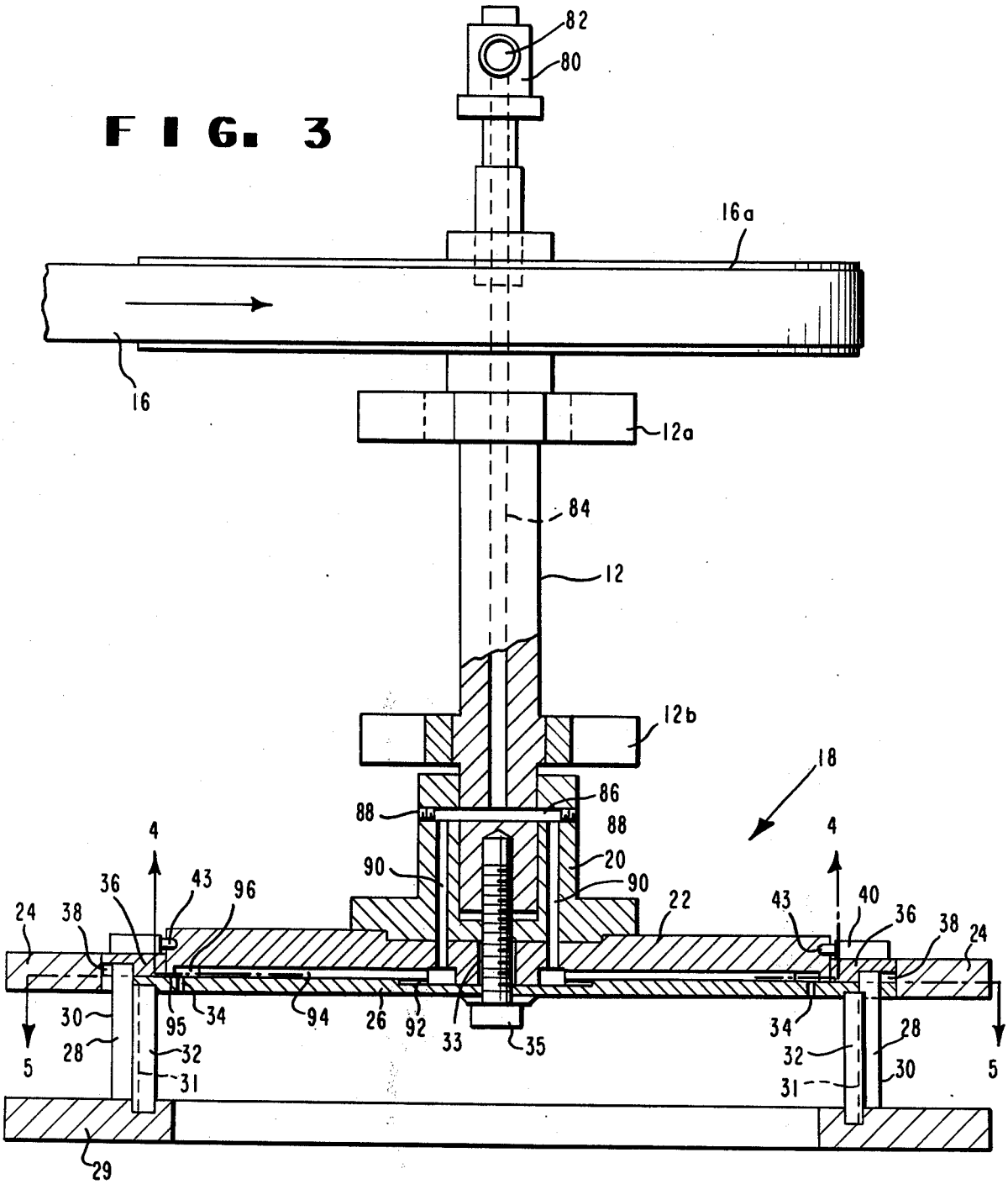
FIG. 3 is an enlarged detailed partially sectioned elevation of the reel and drive shown in FIG. 1.

Referring to FIGS. 1 and 2, the embodiment chosen for purposes of illustration is a cutting apparatus 10 that includes as its major components a drive shaft 12 mounted on a base 14 by means of bearings **12*a* and 12*b* and connected to a cutting reel designated generally 18. The shaft 12 is driven by a motor (not shown) via belt 16 engaging pulley 16*a* attached to shaft 12. Referring to FIG. 3, the cutting reel 18 is seen to comprise a bottom ring 29 attached to and spaced from a top plate 26 by spaced connector posts 32 which are secured in position by any of a number of well known expedients as, for example, brazing. A guiding ring 24 for the material being cut extends circumferentially around top plate 26 and is attached to the peripheral edge of plate 26. As an alternative the ring 24 could be made integral with plate 26. Rectangular cutter blades 28 are inserted through slots in top plate 26 down into grooves in the top of ring 29. When in place, each cutter blade 28 has its cutting edge 30 facing radially outwardly, and its back edge supported in U-groove 31 of a connector post 32 and its top end extending into annular space 38 above plate 26. A cover plate 22 is bolted to top plate 26 (bolts not shown). Fitted between cover plate 22 and tow guiding ring 24 is retaining ring 36 which has a stepped lower surface to provide space 38 into which the top of cutter blade 28 extends. Spaced fasteners 40 are attached to the upper surface of retaining ring 36 and have slide bolts 43 which extend into corresponding holes in the edge of cover plate 22 holding the retaining ring 36 securely in position. Thus, the combination of the cover plate 22, top plate 26, guiding ring 24 and retaining ring 36 from what may be generally referred to as the upper mounting member of the cutting reel 18 while ring 29 will be considered the lower mounting member of the reel. An intermediate hub 20 is used between the reel and drive shaft 12 and these portions are fastened to the upper mounting member by a bolt 35 threaded into the bottom of shaft 12**.

As best shown in FIGS. 1 and 2, a pressure applicator 42 of the rotatable type such as a wheel or roller is mounted on a shaft 44 secured to a bifurcated bracket 46 which in turn is supported on a movable slide 48 fitted into machined ways 50 secured to the base 14. Regulated movement of the slide 48 is accomplished by a lead screw 52 rotatably secured in a pillow block 54 fixed in position relative to machined ways 50 and thus to the base 14. One end 56 of lead screw 52 is threaded into an appendage 58 integral with or otherwise fixed on the surface of the movable slide 48 so that rotation of screw 52 will cause slide 48 to move relative to machined ways 50 and base 14. This structure, a lead screw actuated slide and ways assembly well known in the art, provides for movement of pressure roll 42 relative to cutting reel 18 and minute adjustment of the space between it and cutting edges 30.

A plurality of finger guides 60 or others well known in the art extend outwardly from a plate 62 secured at right angles to the base 14. For operation at high speeds guides 60 may be rolling guides. The finger guides 60 shape the incoming filamentary tow 64 into a flattened tape or band. From the finger guides 60 the filamentary material or tow passes through rounded edge guides 66 which are pivotally mounted on an elongated rod 68 secured, as are finger guides 60, to plate 62. Guides 66 serve to control the width of the flattened tape band 64 so that it will wind snugly between ring 29 and guiding ring 24 of the cutting reel 18. In addition to flattening the incoming tow 64, the finger guides 60 also serve as a friction brake to place the tow under a controlled amount of tension as it is fed into the cutting reel 18.

Figure 7:
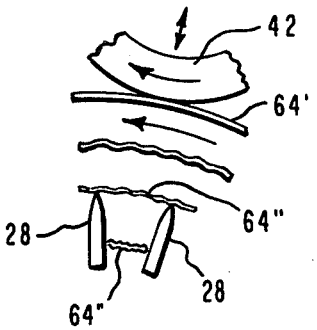
FIG. 7 is an enlarged fragmentary, detail view showing the relationship between the blades, the material being cut and the pressure applicator at the point of cutting.

The apparatus described thus far is a cutting apparatus substantially that disclosed by Cook in U.S. Pat. No. 3,733,945, the operation of which is described in detail at column 4, lines 7–47. The details of the method of cutting are shown in FIG. 7 and described in the Cook patent at column 4, lines 49–66. Although Cook proposes a solution to the problem of the cutter jamming and lack of staple openness by mounting at least one fixed jet so that it jets downwardly through aligned apertures in the cutter reel which rotate past the jet, as discussed previously, Cook's arrangement produces high noise levels because his arrangement is essentially that of a siren.

The improvement of this invention is a modification of the known reel cutters that provides for jet-producing orifices that rotate with the reel and, because they do not interrupt the jet-air flow as with the Cook patent, the increase in noise level in operating these jets is negligible.

Figure 4:
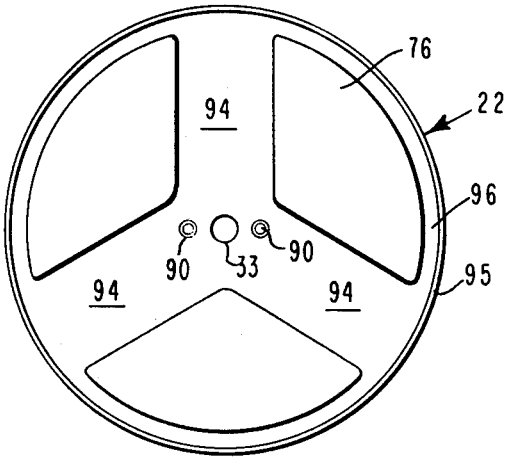
FIG. 4 is a somewhat reduced view taken along 4—4 of FIG. 3 of the cover plate of the cutting reel.

Modifications leading to the improved cutter of this invention include, first, making cover plate 22 of as large a diameter as possible without reducing blade retaining ring 36 so much as to destroy its function. Secondly, passageways are formed so as to continuously communicate from the top of shaft 12 to orifices 34 formed through top plate 26 near its outer extremeties. Thirdly, a rotary union 80 is attached to the top of shaft 12. Fixed piping (not shown) leads high pressure air to rotary union 80 through inlet opening 82 in the rotary union whereby compressed air may be fed to the passageways during rotary operation of the cutter. It is feasible to provide a rotary union around a shaft directly driven by a motor at its end, but the installation is much simpler when the motor is off-set and the rotary union is mounted on the end of the shaft. An axial passageway 84 is provided through most of shaft 12 leading from the inlet 82 and stopping short of the hole receiving bolt 35. At least one transverse passageway 86 is formed through hub 20 and shaft 12 intersecting with the end of passageway 84. The ends of passageway 86 are closed by plugs 88. Next, a pair of passageways 90 is formed vertically through cover plate 22 and hub 20 intersecting at the upper end with passageway 86 and at the lower end with annular chamber 92 formed between cover plate 22 and top plate 26. Channels 94 are machined into the bottom of cover plate 22 and extend from chamber 92 to annular distribution ring 96 also formed in the bottom of cover plate 22 in an area over orifices 34 to form a manifold in communication with each orfice 34, the manifold being in communication with high pressure air through hollow shaft 12. Sealing lip 95, preferably fitted with a gasket, is left around the outside edge to prevent air leakage. Some of these details are best seen in FIG. 4 which is a bottom plan view of modified cover plate 22. Hole 33 provides ready passage of bolt 35. Channels 94 provide as much open passageway as practicable without eliminating unmilled areas 76 at which cover plate 22 is bolted to top plate 26. The number of channels 94 is not critical, but a preferred embodiment has three with a total cross-sectional flow-area equal to or greater than that of passage 84.

Figure 5:
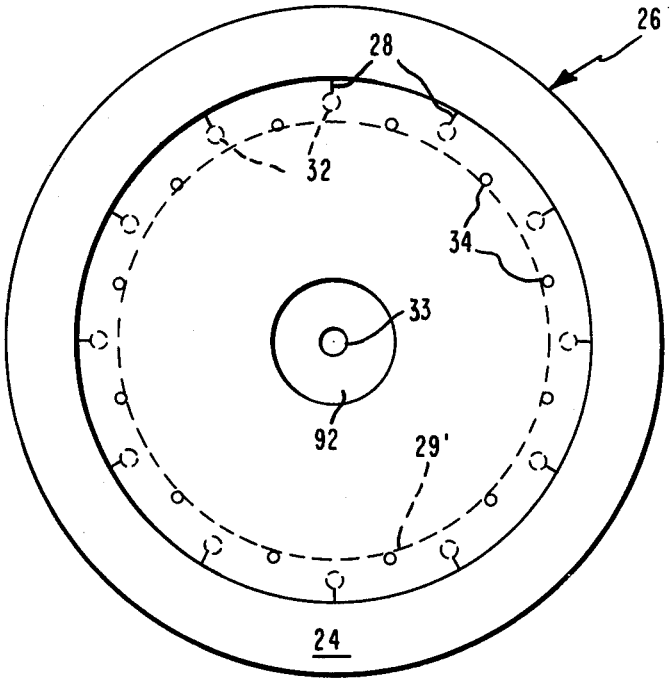
FIG. 5 is a view taken along 5—5 of the cutting reel assembly with the drive shaft, blade retaining ring and cover plate removed.
Figure 6:
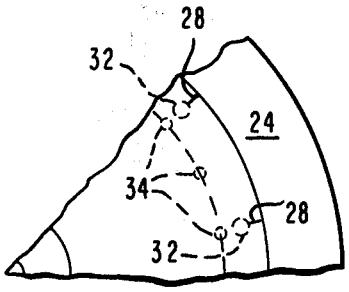
FIG. 6 is a fragmentary detail view showing an alternate plan for arrangement of jet orifices in the top plate member of the cutting reel.

FIG. 5 shows a top plan view of top plate 26. The position of the inner edge of ring 29 is indicated by dashed line 29'. Connector posts 32 support the rear edges of cutter blades 28. Orifices 34 through top plate 26 are shown to exaggerated size for clarity. At least one orifice 34 is provided between each pair of cutter blades 28 angularly centered between the blades and radially located from about the position of edge 29' to a point approximately on a chord joining the inner extremities of adjacent connector posts 32. In an alternate embodiment, as shown in FIG. 6, three orifices 34 are provided between a pair of connector posts 32, one behind each post, where the ends of cut staple tend to get caught and promote tangling and one centered between each pair of posts 32. In each case the orifices are directed in the proximity of the doffing point of the severed material between adjacent knife edges.

Typically the number of connector-post/cutter-blade units is selected in the range of 10 to 60. While they are ordinarily equispaced angularly, they may also be non-uniformly spaced to produce staple with mixed lengths. Orifices 34 should be less than 0.25 inch in each diameter and preferably about 0.075 to 0.10 inch. Each orifice of the latter dimension when continuously jetting air at of the order of 10 scfm produces very energetic jets which strip staple from advancing wads of staple so promptly that not only is jamming of the cutter completely eliminated but also the formation of chips is substantially prevented.

A major advantage of this invention is that, because the orifices rotate with the reel and the jets of air are not intercepted by secondary holes, operation causes only slight increase in noise level. Such considerations have become of extreme importance regarding safe operating environments for workers.

In a typical operation of the equipment described, a 4-million denier nylon-66 tow of 10 dpf filaments is cut to 7.5 inch staple length at a tow-feeding rate of 400 yd/min using a cutting reel with a diameter between blade tips of about 26.5 inches. Orifices 34 are 0.078 inch in diameter and one is positioned at the mid-point of each chord joining the inner extremities of each pair of adjacent connector posts 32. Air fed to rotary union 80 is from a 90 psig supply, and each orifice 34 passes about 10 scfm of air. The increase in noise level adjacent the cutter using these air jets is no more than 2 dba greater than for an unmodified but otherwise identical cutter. Openness and uniformity of the cut staple product are excellent.

What is claimed is:

1. In an apparatus for cutting filamentary material into predetermined lengths comprising a cutting assembly including a plurality of knife edges secured to a reel having an upper and a lower mounting member and having means adapted to receive successive wrappings of filamentary material to be cut in contact with said plurality of knife edges and means for forcing said material between adjacent knife edges to a doffing point thereby severing said filamentary material into lengths of controlled dimensions, the improvement comprising means for removing the severed material, said means comprising: an orifice in said upper mounting member directed toward the proximity of the doffing point of the severed material; and means communicating with said orifice for continuously supplying pressurized fluid thereto.

2. The apparatus as defined in claim 1, said means for supplying pressurized fluid being a manifold in communication with said orifice attached to said upper mounting member and means for supplying pressurized fluid to said manifold.

3. The apparatus as defined in claim 1, said orifice having a diameter of from about 0.075 to 0.10 inch.

4. In an apparatus for cutting filamentary material into predetermined lengths comprising a cutting assembly including a plurality of knife edges secured to a reel having an upper and a lower mounting member and having means adapted to receive successive wrappings of filamentary material to be cut in contact with said plurality of knife edges and means for forcing said material between adjacent knife edges to a doffing point thereby severing said material into lenghts of controlled dimensions, the improvement comprising: a plurality of orifices in said upper mounting member, there being at least one orifice between each pair of knife edges directed toward the proximity of the doffing point of the severed material and means communicating with each orifice for continuously supplying pressurized fluid thereto.

5. The apparatus as defined in claim 4, said means for supplying pressurized fluid being a manifold in communication with each orifice and means for supplying pressurized fluid to said manifold.

6. The apparatus as defined in claim 4, there being one orifice behind each knife edge and one orifice centered between each pair of knife edges.

7. The apparatus as defined in claim 4, said orifices having a diameter of from about 0.075 to about 0.10 inch.

8. The apparatus as defined in claim 4, said means communicating with each orifice for continuously supplying pressurized fluid thereto comprising a hollow drive shaft connected at one end to said upper mounting member and connected at its other end to a source of pressurized fluid; and a manifold formed in said upper mounting member, said manifold being in communication with said hollow drive shaft and each of said orifices to supply pressurized fluid thereto.

* * * * *